US007833359B2

(12) United States Patent
Suzuki et al.

(10) Patent No.: US 7,833,359 B2
(45) Date of Patent: Nov. 16, 2010

(54) METHOD FOR CLEANING, EMPLOYING A SURFACTANT FOR FINE-BUBBLE FORMATION

(75) Inventors: Kazumitsu Suzuki, Kyoto (JP); Masahiro Matsuoka, Kyoto (JP); Satoshi Ueyama, Chiyoda-ku (JP); Makoto Miyamoto, Chiyoda-ku (JP)

(73) Assignees: Sanyo Chemical Industries, Ltd, Kyoto-shi (JP); Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 12/415,156

(22) Filed: Mar. 31, 2009

(65) Prior Publication Data

US 2009/0233828 A1 Sep. 17, 2009

Related U.S. Application Data

(62) Division of application No. 11/813,050, filed as application No. PCT/JP2005/023930 on Dec. 27, 2005, now abandoned.

(30) Foreign Application Priority Data

Dec. 28, 2004 (JP) ..... 2004-381526

(51) Int. Cl.
*B08B 3/04* (2006.01)
*B08B 3/10* (2006.01)
*C11D 1/72* (2006.01)

(52) U.S. Cl. ..... 134/42; 510/360; 510/413; 510/421; 510/475; 510/505; 510/524; 510/535; 8/137; 424/9.52; 424/43; 424/70.31

(58) Field of Classification Search ..... 510/360, 510/413, 421, 475, 505, 524, 535; 8/137; 134/42; 424/9.52, 43, 70.31

See application file for complete search history.

(56) References Cited

U.S. PATENT DOCUMENTS 5,352,436 A 10/1994 Wheatley et al.

(Continued)

FOREIGN PATENT DOCUMENTS

AO 2003-119494 4/2003

(Continued)

OTHER PUBLICATIONS

Shu Takagi et al., "Behavior of a Rising Bubble in Water with Surfractant Dissolution," Department of Mechanical Engineering, the Universeity of Tokyo, (Oct. 2003), No. 03-110.

(Continued)

*Primary Examiner*—Brian P Mruk
(74) *Attorney, Agent, or Firm*—Oblon, Spivak, McClelland, Maier & Neustadt, L.L.P.

(57) ABSTRACT

A method for cleaning articles using a surfactant which is effective in the formation of stable microbubbles is provided. The surfactant for microbubble formation contains a (poly) oxyalkylene adduct (A) of an active hydrogen atom-containing compound (a) represented by formula (1)

$$Z\text{-}[(AO)_n\text{—}H]_p \quad (1)$$

wherein Z is the residue of an active hydrogen-containing compound (a) with a valence of P resulting from removal of the active hydrogen atom or atoms; A is an alkylene group containing 1 to 8 carbon atoms; n is an integer of 1 to 400; and p is an integer of 1 to 100. The foaming power of a 0.02% by weight aqueous solution of the (poly)oxyalkylene adduct (A) as measured at 20° C. by the Ross Miles test is not higher than 50 mm.

16 Claims, 2 Drawing Sheets

U.S. PATENT DOCUMENTS

| | | | | |
|---|---|---|---|---|
| 5,639,443 | A | 6/1997 | Schutt et al. | |
| 5,885,950 | A * | 3/1999 | Dale et al. | 510/194 |
| 6,462,014 | B1 | 10/2002 | Johnson et al. | |

FOREIGN PATENT DOCUMENTS

| | | | |
|---|---|---|---|
| CN | 1403206 | A | 3/2003 |
| JP | 2 293078 | | 12/1990 |
| JP | 8 502979 | | 4/1996 |
| JP | 9 501164 | | 2/1997 |
| JP | 2004-059886 | | 2/2004 |
| JP | 2004 532915 | | 10/2004 |
| JP | 2005-118462 | | 5/2005 |
| WO | WO 94/09703 | | 5/1994 |
| WO | WO 95/03835 | | 2/1995 |
| WO | WO 02/081610 | | 10/2002 |

OTHER PUBLICATIONS

Robert Fedors, "A Method for Estimating Both the Solubility Parameters and Molar Volumes of Liquids," Polymer Engineering and Science, Feb. 1974, vol. 14, No. 2.

* cited by examiner

METHOD FOR CLEANING, EMPLOYING A SURFACTANT FOR FINE-BUBBLE FORMATION

CROSS REFERENCE TO RELATED APPLICATIONS

This application is a divisional application of prior U.S. application Ser. No. 11/813,050, filed Feb. 22, 2008, now abandoned, which was the National Stage of PCT Application No. PCT/JP05/23930, filed Dec. 27, 2005, the disclosures of which are incorporated herein by reference in their entireties. The parent application claims priority to Japanese Application No. 2004-381526, filed Dec. 28, 2004, the disclosure of which is incorporated herein by reference in its entirety.

BACKGROUND OF THE INVENTION

The present invention relates to a surfactant for microbubble formation and to a detergent composition comprising the same.

In recent years, microbubbles in water, such as microbubbbles of the order of micrometers in diameter or nanobubbles of the order of nanometers in diameter have been widely studied and, owing to their utility, various applications of these microbubbles (referring to bubbles not greater than 1 mm in diameter; hereinafter the same shall apply), for example in cleaning machine parts, have been proposed.

For generating these microbubbles stably, the technique comprising adding a surfactant to water or the like in advance has been proposed (Non-Patent Document 1).

However, the surfactants described in the above-cited Non-Patent Document 1 have problems, for example the problem of how to generate such microbubbles as mentioned above, the problem in that the microbubbles obtained are unstable and the effect thereof can hardly be sustained for a long period of time and the problem in that bubbles (referring to larger bubbles than the microbubbles defined hereinabove, for example bubbles exceeding 1 mm in diameter; hereinafter the same shall apply) are generated in the microbubble forming apparatus, making it difficult to handle the apparatus.

Non-Patent Document 1: The Japan Society of Mechanical Engineers Collected Papers (Series B), Vol. 69, No. 686, pp. 16-23 (2003; published by the Japan Society of Mechanical Engineers)

SUMMARY OF THE INVENTION

Accordingly, it is an object of the present invention to provide a surfactant capable of facilitating the generation of microbubbles and highly effective in stabilizing the microbubbles so obtained for a long period of time. A further object is to provide a surfactant which, when used in the conventional microbubble forming apparatus, makes it possible to exclusively obtain the desired microbubbles without causing such a trouble that bubbles overflow from the apparatus due to violent foaming, making the handling thereof difficult.

The present inventors made intensive investigations in attempt to obtain such a surfactant as mentioned above and, as a result, found that the problems mentioned above can be solved by using a nonionic surfactant having a specific structure and, based on such and other findings, they have now completed the present invention.

Thus, the present invention provides a surfactant for microbubble formation which comprises a (poly)oxyalkylene adduct (A) of an active hydrogen atom-containing compound (a) as represented by the general formula (1) given below and that the foaming power of a 0.02% (by weight) aqueous solution of said adduct (A) as measured at 20° C. by the Ross Miles test is not higher than 50 mm;

a detergent which comprises the surfactant for microbubble formation;

a method for cleaning articles to be cleaned which comprises the step of generating microbubbles using the detergent; and a method for generating microbubbles in water using the surfactant for microbubble formation or the detergent.

$$Z\text{-}[(AO)_n\text{—}H]_p \quad (1)$$

(in the above formula, Z is the residue of an active hydrogen-containing compound with a valence of P as resulting from removal of the active hydrogen atom or atoms; A is an alkylene group containing 1 to 8 carbon atoms; n is an integer of 1 to 400; and p is an integer of 1 to 100).

DETAILED DESCRIPTION OF THE PREFERRED EMBODIMENTS

In the following, the invention is described in detail.

The surfactant for microbubble formation according to the invention comprises the above-mentioned (poly)oxyalkylene adduct (A) and the foaming power of a 0.02% (by weight) aqueous solution of the adduct (A) as determined by the Ross Miles test (20° C.) is not higher than 50 mm.

The (poly)oxyalkylene adduct (A) is a compound resulting from binding of 1 or 2 to 400 oxyalkylene groups to an active hydrogen atom-containing compound (a), and the prefix "poly" in (poly)oxyalkylene adduct (A) corresponds to the case where n=2 to 400 in the general formula (1). When n=1, the adduct (A) is a hydro-mono(oxyalkylene) adduct. The term "(poly)oxyalkylene adduct" includes, within the meaning thereof, both the cases where n=1, namely hydro-mono (oxyalkylene) adduct, and n=2 to 400, namely polyoxyalkylene adduct.

The "foaming power as determined by the Ross Miles test (20° C.)" so referred to herein can be measured in accordance with JIS K 3362 (1998) and is the value of the foam height just after flowing out of all the test solution as measured by visual observation in a test using an apparatus prescribed in that JIS standard and using, as a test solution, a 0.02% (by weight) aqueous solution of the surfactant as prepared using deionized water.

The "foam stability" so referred to herein indicates the foam height after the lapse of 5 minutes just following completion of flowing out of all the test solution in the Ross Miles test. The foam stability can be measured in accordance with JIS K 3362 (1998).

More specifically, the foaming power and foam stability can be determined, for example, in the following manner.

1) The inside cylinder of a conventional foaming power measuring apparatus for the Ross Miles test is set up vertically, and a constant temperature (20° C.) is maintained by circulating water as specified through the outer cylinder by means of a pump.

2) A 50-ml portion of the test solution (0.02% (by weight) aqueous solution of the surfactant), while maintained at the same temperature (20° C.), is poured gently into the inside cylinder along the tube wall thereof so that it may wet the whole side of that wall.
3) A 200-ml portion of the test solution is pipetted, the upper end cock of the foaming power measuring apparatus for Ross Miles test is opened, and the test solution is allowed to flow down so that the whole portion of the test solution may flow out in about 30 seconds and each drop of the solution may fall onto the center of the liquid surface in the inside cylinder.
4) After flowing out of the whole solution, the foam height (foaming power) (mm) is measured by visual observation.
5) Further, after 5 minutes, the foam height (foam stability) (mm) is measured by visual observation.
6) The above procedure is repeated several times, and the means of the respective measured values to the position of integer and recorded as the foaming power and foam stability.

From the viewpoint of inhibiting foaming during use, the foaming power is preferably not higher than 40 mm, more preferably not higher than 30 mm, particularly preferably not higher than 20 mm, most preferably not higher than 10 mm. The lower limit to the foaming powder is 0 mm.

From the same viewpoint as mentioned above, the foam stability is preferably not higher than 35 mm, more preferably not higher than 15 mm, particularly preferably not higher than 10 mm, most preferably not higher than 5 mm. The lower limit to the foam stability is 0 mm.

Further, from the viewpoint that foaming is less on the occasion of use and the foams generated rapidly disappear (are broken), hence stable use is possible, the foaming power is 0 mm or the ratio between foam stability and foaming power as represented by [foam stability (mm)/foaming power (mm)] is preferably 0 to 0.70, particularly preferably 0 to 0.5, most preferably 0 to 0.2.

When the foaming power is 0 mm, the foam stability is also 0 mm, and the above calculation formula [foam stability (mm)/foaming power (mm)] cannot be calculated, hence the above calculation formula is not applied.

In the general formula (1) representing the (poly)oxyalkylene adduct (A) according to the invention, Z is a residue of an active hydrogen atom-containing compound (a) as resulting form removal of an active hydrogen atom or atoms therefrom and having a valence of p. The "active hydrogen atom(s)" so referred to herein is (are) an active hydrogen atom(s) bound to a nonmetal hetero atom(s) other than carbon atom(s), preferably an oxygen, nitrogen, phosphorus or sulfur atom-bound active hydrogen atom(s).

The "active hydrogen atom-containing compound (a) having a valence of p" so referred to herein is a compound having p active hydrogen atoms each bound to a nonmetal heteroatom other than a carbon atom, such as mentioned above. As such active hydrogen atom-containing compound (a) having a valence of p, there may be mentioned hydroxyl group-containing compounds (a1), amino group-containing compounds (a2), carboxyl group-containing compounds (a3), mercapto group-containing compounds (a4), phosphoric acid compounds (a5), compounds containing two or more active hydrogen atom-containing functional group species within the molecule (a6); and mixtures of two or more of these.

As the hydroxyl group-containing compounds (a1), there may be mentioned those monohydric alcohols (a11), polyhydric (di- to octahydric) alcohols (a12), monohydric phenols (a 13), polyhydric phenols (a14) and other polyhydric alcohols (a15), among others.

As (a11), there may be mentioned monohydric alcohols containing 1 to 18 carbon atoms, preferably 1 to 8 carbon atoms, such as methanol, ethanol, n-propanol, isopropanol, n-butanol, sec-butanol, 1-pentanol, allyl alcohol, and synthetic or natural higher alcohols [e.g. synthetic alcohols containing 14 to 15 carbon atoms (such commercial products as "Dobanol 45", product of Mitsubishi Chemical Corp.)].

As (a12), there may be mentioned dihydric alcohols containing 2 to 18 carbon atoms, such as ethylene glycol, 1,2-propylene glycol, 1,3-propylene glycol, 1,3-butylene glycol, 1,4-butanediol, 1,6-hexanediol, 3-methylpentanediol, diethylene glycol, neopentyl glycol, 1,4-bis(hydroxymethyl)cyclohexane, 1,4-bis(hydroxyethyl)benzene and 2,2-bis(4,4'-hydroxycyclohexyl)-propane; trihydric alcohols containing 3 to 18 carbon atoms, such as glycerol and trimethylolpropane; and tetra- to octahydric alcohols such as pentaerythritol, diglycerol, triglycerol, α-methyl glucoside, sorbitol, xylitol, mannitol, dipentaerythritol, glucose, fructose and sucrose.

As (a 13), there may be mentioned monohydric phenols such as phenol and alkylphenols having an alkyl group containing 1 to 6 carbon atoms (e.g. cresol, p-ethylphenol, etc.).

As (a14), there may be mentioned polyhydric phenol such as pyrogallol, catechol, hydroquione, bisphenols (e.g. bisphenol A, bisphenol F, bisphenol S, etc.) and trisphenols (e.g. trisphenol PA etc.).

As (a15), there may be mentioned cellulosic compounds (e.g. methylcellulose, ethylcellulose, hydroxyethylcellulose, ethylhydroxyethylcellulose, carboxymethylcellulose, hydroxypropylcellulose, and hydrolyzates thereof), gelatin, starch, dextrin, novolak resins (e.g. phenol novolak, cresol novolak, etc.), polyphenols, polybutadiene polyols, castor oil type polyols, and other polyhydric alcohols, for example poly (2 to 100) functional polyols such as hydroxyalkyl (meth) acrylate (co)polymers and polyvinyl alcohol, among others.

As the amino group-containing compounds (a2), there may be mentioned ammonia, monoamines (a21), polyamines (a22), amino alcohols (a23) and other amino compounds (a24).

As specific examples of (a21), there may be mentioned alkylmonoamines containing 1 to 20 carbon atoms (butylamine etc.), aromatic monoamines containing 6 to 18 carbon atoms (aniline etc.) and like monoamines.

As (a22), there may be mentioned aliphatic polyamines such as ethylenediamine, trimethylenediamine, hexamethylenediamine and diethylenetriamine; heterocyclic polyamines such as piperazine and N-aminoethylpiperazine; alicyclic polyamines such as dicyclohexylmethanediamine and isophoronediamine; aromatic polyamines such as phenylenediamine, tolylenediamine, diethyltolylenediamine, xylylenediamine, diphenylmethanediamine, diphenyl ether diamine and polyphenylmethanepolyamine; polyamidepolyamines obtained by condensation of a dicarboxylic acid and an excess of a polyamine; and polyetherpolyamines, among others.

As (a23), there may be mentioned amino alcohols such as monoethanolamine, diethanolamine, triethanolamine and triisopropanolamine; in this case, alcohol and amine active hydrogen atoms collectively correspond to the valence p).

As (a24), there may be mentioned hydrazines (hydrazine and monoalkylhydrazines), dihydrazides (succinic dihydrazide, adipic dihydrazide, isophthalic dihydrazide, terephthalic dihydrazide, etc.), guanidines (butylguanidine, 1-cyanoguanidine, etc.) and dicyandiamides.

Further, mention may be made of mixtures of two or more of the compounds mentioned above.

As the carboxyl group-containing compounds (a3), there may be mentioned, among others, aliphatic monocarboxylic acids (a31) such as acetic acid and propionic acid; aromatic monocarboxylic acids (a32) such as benzoic acid; aliphatic polycarboxylic acids (a33) such as succinic acid and adipic acid; aromatic polycarboxylic acids (a34) such as phthalic acid, terephthalic acid and trimellitic acid; and polycarboxylic acid polymers (number of functional groups: 2 to 100) (a35) such as acrylic acid (co)polymers.

As the mercapto group-containing compounds (a4), there may be mentioned di- to octavalent polyhydric thiols. More specifically, mention may be made of ethylenedithiol, propylenedithiol, 1,3-butylenedithiol, 1,4-butanedithiol, 1,6-hexanedithiol and 3-methylpentanedithiol.

As the phosphoric acid compounds (a5), there may be mentioned phosphoric acid, phosphonic acids, and the like.

As the compounds (a6) containing two or more active hydrogen atom-containing functional group species within the molecule, there may further be mentioned compounds containing two or more functional groups each selected from among hydroxyl, amino, carboxyl, mercapto and phosphoric acid groups, for example those compounds derived from the above-mentioned hydroxyl group-containing compounds (a1), amino group-containing compounds (a2), carboxyl group-containing compounds (a3), mercapto group-containing compounds (a4) or phosphoric acid compounds (a5) by further substitution of a part of the active hydrogen atom-containing functional groups thereof by at least one different active hydrogen atom-containing functional group species.

Among such active hydrogen atom-containing compounds (a), hydroxyl group-containing compounds (a1), amino group-containing compounds (a2) and carboxyl group-containing compounds (a3) are preferred from the foam stability viewpoint. More preferred are monohydric alcohols (all) and poly(di- to octa-)hydric alcohols (a12) among (a1) as well as monoamines (a21), polyamines (a22) and alkanolamines (a23) among (a2); (a11) and (a12) species are particularly preferred, and (a12) species are most preferred.

In the present invention, p in the formula (1) represents an integer of 1 to 100. The value of p corresponds to the number of active hydrogen atoms possessed by the active hydrogen atom-containing compound (a). In the case of those compounds (a1) and (a12) which are preferred among the active hydrogen atom-containing compounds (a), the value of p is not particularly restricted but preferably is 1 to 8, more preferably 2 to 8.

In the general formula (1), A is an alkylene group containing 1 to 8 carbon atoms, including, for example, ethylene, 1,2-propylene, 1,2-butylene, 2,3-butylene, 1,4-butylene and 1-phenyl-1,2-ethylene. Among these, at least one species selected from the group consisting of ethylene, 1,2-propylene, 1,4-butylene and 1-phenyl-1,2-ethylene is preferred from the foam stability viewpoint.

In the formula, AO may also be a copolymer of two or more species and, in the case of a copolymer, it may be a random copolymer or a block copolymer.

In the formula, n is an integer of 1 to 400 and, from the viewpoint of bubble diameter controlling and foaming suppression on the occasion of use, it is preferably 1 to 175, more preferably 1 to 60, particularly preferably 1 to 30, most preferably 1 to 10.

The solubility parameter (hereinafter referred to as SP value for short) of the (poly)oxyalkylene adduct (A) is preferably 9 to 16, particularly preferably 9 to 14. When the SP value is within such range, microbubbles can be obtained with ease.

The SP value of (a) is preferably 11 to 30, particularly preferably 12 to 20. When the SP value of (a) is within such range, foaming is favorably slight during use.

The SP value so referred to herein is represented by the square root of the cohesive energy density-to-molar volume ratio, as follows:

$$[SP\ \text{value}]=(\Delta E/V)^{1/2}.$$

In the above formula, ΔE represents the cohesive energy density, and V represents the molar volume. The SP value is calculated according to Robert F. Fedors et al., as described, for example, in Polymer Engineering and Science, Vol. 14, pp. 147-154 (1974).

The method for producing the (poly)oxyalkylene adduct (A) is not particularly restricted but, for example, such known methods as the etherification reaction using a catalyst (e.g. sulfuric acid), the etherification reaction using an organic halide (e.g. Williamson reaction) and the addition reaction of an alkylene oxide (b) can be utilized.

Among those methods, any process based on the addition reaction of an alkylene oxide (b) is preferred from the ease of industrial production viewpoint.

For example, the adduct (A) can be produced by charging a stainless steel autoclave equipped with a stirrer and a temperature control function with an active hydrogen atom-containing compound (a) and a catalyst (e.g. sodium hydroxide or potassium hydroxide), if necessary together with a solvent (e.g. toluene) containing no active hydrogen atom within the molecule, causing the system inside to be sufficiently dehydrated if necessary, and adding an alkylene oxide (b) dropwise for reacting with the compound (a) under predetermined reaction temperature (e.g. 80 to 150° C.) and pressure (e.g. 0.1 to 0.3 MPa) conditions. After the reaction, the residual catalyst may be removed using an adsorbent, for instance, according to need.

As the alkylene oxide (b), there may be mentioned alkylene oxides containing 2 to 8 carbon atoms, for example ethylene oxide (hereinafter referred to as EO for short), 1,2-propylene oxide (hereinafter referred to as PO for short), 1,2- or 2,3-butylene oxide, tetrahydrofuran and styrene oxide.

Among those, EO, PO, tetrahydrofuran and styrene oxide are preferred, and EO and PO are particularly preferred. Two or more species of (b) may also be used and, when two or more such species are used, the mode of addition may be of the block or random polymerization type.

The number of moles of (b) added is equal to n in the general formula (1) given hereinabove. The preferred range thereof is also the same.

The surfactant for microbubble formation according to the invention generally comprises the adduct (A) alone.

The surfactant for microbubble formation according to the invention is liquid or solid in shape.

In the case of a solid, it may have any of such known shapes as powders, granules, blocks or plates.

In the practice of the invention, the detergent comprising the above-mentioned surfactant for microbubble formation may be a detergent comprising the above-mentioned surfactant alone or an aqueous composition comprising the above-mentioned surfactant or may comprise one or more other components.

In the case of an aqueous composition, it may be an aqueous solution as diluted with water, or an emulsion or suspension as emulsified or dispersed in water. The concentration of the surfactant of the invention in the aqueous solution, emulsion or suspension is generally not lower than 10% by weight, preferably 20 to 99.9% by weight.

As the water-soluble organic solvent which may be contained in the aqueous composition, there may be mentioned sulfoxide type solvents (dimethyl sulfoxide etc.); sulfone type solvents (dimethyl sulfone, diethyl sulfone, bis(2-hydroxyethyl) sulfone, etc.); amide type solvents (N,N-dimethylformamide, N-methylformamide, N,N-dimethylacetamide, etc.); lactam type solvents (N-methyl-2-pyrrolidone, N-ethyl-2-pyrrolidone, N-hydroxymethyl-2-pyrrolidone, etc.); lactone type solvents (β-propiolactone, γ-butyrolactone, γ-valerolactone, etc.); alcohol type solvents (e.g. those enumerated hereinabove); and glycol type solvents (e.g. those enumerated hereinabove).

From the bubble stability viewpoint, the proportion of such water-soluble organic solvents is preferably not higher than 20 parts by weight per 100 parts by weight of the surfactant of the invention. Further, it is preferably not higher than 30% by weight of the total weight of water and the water-soluble organic solvent.

The detergent of the invention may contain one or more other components at respective levels at which the effects of the invention will not be impaired.

As the other components, there may be mentioned other surfactants, antifoaming agents, antioxidants, chelating agents, rust preventives, pH adjusting agents and pH buffering agents, among others.

As other surfactants, there may be mentioned ionic surfactants such as anionic surfactants, cationic surfactants and amphoteric surfactants as well as nonionic surfactants other than the surfactants (A) according to the invention. These may be used singly or two or more of them may be used in admixture.

As the anionic surfactants, there may be mentioned, for example, carboxylic acid salts [salts of saturated or unsaturated fatty acids containing 8 to 22 carbon atoms]; salts of carboxymethylation products [salts of carboxymethylation products derived from aliphatic alcohols containing 8 to 16 carbon atoms or EO (1 to 10 moles) adducts thereof]; sulfate ester salts [sulfate ester salts derived from aliphatic alcohols containing 8 to 18 carbon atoms or EO (1 to 10 moles) adducts thereof]; sulfated oils [salts derived from natural unsaturated fats or oils or unsaturated waxes as such by sulfation, followed by neutralization]; sulfated fatty acid esters [salts derived from unsaturated fatty acid lower alcohol esters by sulfation, followed by neutralization]; sulfated olefins [salts derived from olefins containing 12 to 18 carbon atoms by sulfation, followed by neutralization]; sulfonic acid salts [alkylbenzenesulfonic acid salts, alkylnaphthalenesulfonic acid salts, sulfosuccinic acid dialkyl ester salts, α-olefin(C12-18)sulfonic acid salts, Igepon T species, etc.]; phosphoric acid ester slats [phosphate ester salts of higher alcohol (C8-60) or EO (1 to 10 moles) adducts thereof, alkyl(C4-60) phenol EO adduct phosphate ester salts, etc.].

The salts mentioned above include alkali metal (sodium, potassium, etc.) salts, alkaline earth metal (calcium, magnesium, etc.) salts, ammonium salts, alkylamine (containing 1 to 20 carbon atoms) salts and alkanolamine salts (containing 2 to 12 carbon atoms; e.g. mono-, di- and triethanolamine) salts, among others.

Further, mention may be made of those anionic surfactants described in U.S. Pat. No. 4,331,447, columns 4 to 7.

As the cationic surfactants, there may be mentioned quaternary ammonium salt type cationic surfactants and amine salt type cationic surfactants.

As the quaternary ammonium salt type ones, there may be mentioned tetraalkyl (4 to 80 carbon atoms in total) ammonium salts [lauryltrimethylammonium chloride, didecyldimethylammonium chloride, etc.]; trialkyl(3 to 80 carbon atoms in total)benzylammonium salts [lauryldimethylbenzylammonium chloride=benzalkonium chloride etc.]; alkyl(2 to 60 carbon atoms)pyridinium salts; and polyoxyalkylene(2 to 4 carbon atoms)trialkylammonium salts, among others.

As the amine salt type ones, there may be mentioned aliphatic higher amine salts [inorganic acid salts (hydrochlorides, sulfates, phosphates, etc.) or organic acid salts (acetates, laurates, oleates, adipates, etc.) of amines containing 12 to 60 carbon atoms (laurylamine, stearylamine, etc.)]; and higher fatty acid salts of lower amines [higher fatty acid salts (stearates, oleates, etc.) of amines containing 1 to 11 carbon atoms and so forth], among others.

Further, mention may be made of those cationic surfactants described in U.S. Pat. No. 4,331,447, columns 7 to 9.

As the amphoteric surfactants, there may be mentioned amino acid type amphoteric surfactants [sodium higher alkylamine(12 to 18 carbon atoms)propionates etc.]; betaine type amphoteric surfactants [alkyl(12 to 18 carbon atoms)dimethylbetaines, alkyl(12 to 18 carbon atoms)dihydroxyethylbetaines, coco fatty acid amidopropylbetaines, etc.]; sulfate ester type amphoteric surfactants [higher alkyl(8 to 18 carbon atoms)amine sulfate ester sodium salts, hydroxyethylimidazolidine sulfate ester sodium salts, etc.]; sulfonic acid type amphoteric surfactants (pentadecylsulfotaurine, imidazolinesulfonic acid, etc.); phosphate ester type amphoteric surfactants [glycerol higher fatty acid (8 to 22 carbon atoms) ester phosphate ester amine salts], among others.

Further, mention may be made of amphoteric surfactants described in U.S. Pat. No. 4,331,447, columns 9 to 10.

As the nonionic surfactants other than (A), there may be mentioned those nonionic surfactants represented by the above general formula (1) which show a foaming power exceeding 50 mm in the Ross Miles test [e.g. polyethylene glycol monoalkyl (10 to 18 carbon atoms) ethers {e.g. polyethylene glycol monolauryl ether, polyethylene glycol monomyristyl ether, polyethylene glycol monocetyl ether, polyethylene glycol monostearyl ether, polyethylene glycol monooleyl ether, etc.}, polyethylene glycol monoalkyl(8 to 18 carbon atoms)phenyl ethers {e.g. polyethylene glycol monooctylphenyl ether, polyethylene glycol monononylphenyl ether, polyethylene glycol mono-p-isooctylphenyl ether (trade name: "Triton(R) X-100": product of Wako Pure Chemical Industries), etc.} and so forth] and polyhydric alcohol type nonionic surfactants [e.g. glycerol fatty acid esters, pentaerythritol fatty acid esters, sorbitol fatty acid esters, sorbitan fatty acid esters, sucrose fatty acid esters, alkanolamine fatty acid amides, etc.].

When such a surfactant is contained in the detergent of the invention, the proportion thereof is preferably not higher than 10 parts by weight per 100 parts by weight of the surfactant of the invention from the bubble stability viewpoint.

As the antioxidants, there may be mentioned, for example, phenolic antioxidants (2,6-di-tert-butylphenol, 2-tert-butyl-4-methoxyphenol, 2,4-dimethyl-6-tert-butylphenol, etc.); amine type antioxidants (monoalkyldiphenylamines such as monooctyldiphenylamine and monononyldiphenylamine, dialkyldiphenylamines such as 4,4'-dibutyldiphenylamine and 4,4'-dipentyldiphenylamine, polyalkyldiphenylamines such as tetrabutyldiphenylamine and tetrahexyldiphenylamine, naphthylamines such as α-naphtylamine and phenyl-α-naphthylamine, etc.); sulfur-containing compounds {phenothiazine, pentaerythritol tetrakis(3-laurylthiopropionate), bis(3,5-di-tert-butyl-4-hydroxybenzyl)sulfide, etc.}; phosphorus-containing antioxidants {bis(2,4-di-tert-butylphenyl) pentaerythritol diphosphite, phenyl diisodecyl phosphite, dipenyl diisooctyl phosphite, triphenyl phosphite, etc.}; and so forth.

When such an antioxidant is contained in the detergent of the invention, the proportion thereof is preferably not higher than 5 parts by weight per 100 parts by weight of the surfactant of the invention from the bubble stability viewpoint.

As the chelating agents there may be mentioned, for example, aminopolycarboxylic acids {ethylenediaminetetraacetic acid (EDTA), hydroxyethylethylenediaminetriacetic acid (HEDTA), dihydroxyethylethylenediaminetetraacetic acid (DHEDDA), nitrilotriacetic acid (NTA), hydroxyethyliminodiacetic acid (HIDA), etc.} and ammonium or organic alkali salts, etc.; phosphonic acids (methyldiphosphonic acid, aminotrismethylenephosphonic acid, ethylidenediphsophonic acid, ethylaminobismethylenephosphonic acid, ethylenediaminebismethylenephosphonic acid, etc.) and inorganic alkali salts (lithium salt, sodium salt, potassium salt, etc.), ammonium salts and organic alkali salts (alkanolamine salts such as triethanolamine salts, etc.) thereof; and so forth.

When such a chelating agent is contained in the detergent of the invention, the proportion thereof is preferably not higher than 10 parts by weight per 100 parts by weight of the surfactant of the invention from the bubble stability viewpoint.

As the rust preventives, there may be mentioned, for example, nitrogen-containing organic rust preventives such as benzotriazole, tolyltriazole, benzotriazole derivates having a hydrocarbon group containing 2 to 10 carbon atoms, benzimidazole, imidazole derivatives having a hydrocarbon group containing 2 to 20 carbon atoms, thiazole derivatives having a hydrocarbon group containing 2 to 20 carbon atoms, and 2-mercaptobenzothiazole; alkyl- or alkenylsuccinic acid derivatives such as dodecenylsuccinic acid half esters, octadecenylsuccinic anhydride and dodecenylsuccinamide; and polyhydric alcohol partial esters such as sorbitan monooleate, glycerol monooleate and pentaerythritol monooleate.

When such a rust preventive is contained in the detergent of the invention, the proportion thereof is preferably not higher than 10 parts by weight per 100 parts by weight of the surfactant of the invention from the bubble stability viewpoint.

As the pH adjusting agents, there may be mentioned, for example, organic acids such as citric acid, oxalic acid, gluconic acid, lactic acid, tartaric acid, maleic acid, acetic acid and formic acid; inorganic acids such as hydrochloric acid, sulfuric acid and phosphoric acid; inorganic alkalis such as lithium hydroxide, sodium hydroxide, potassium hydroxide and ammonia; and organic alkalis such as alkanolamines (triethanolamine etc.).

When such a pH adjusting agent is contained in the detergent of the invention, the proportion thereof is preferably not higher than 10 parts by weight per 100 parts by weight of the surfactant of the invention from the bubble stability viewpoint. As the buffering agents, use may be made of, for example, organic acids, inorganic acids, and salts thereof, which have a pH buffering action.

As the organic acids, there may be mentioned, for example, citric acid, glycolic acid, succinic acid, tartaric acid, lactic acid, fumaric acid, malic acid, levulinic acid, butyric acid, valeric acid, oxalic acid, maleic acid and mandelic acid. As the inorganic acids, there may be mentioned, for example, phosphoric acid, boric acid, sulfuric acid and nitric acid. As the salts of these, there may be mentioned, for example, salts with those inorganic alkalis and organic alkalis enumerated hereinabove.

When such a buffering agent is contained in the detergent of the invention, the proportion thereof is preferably not higher than 10 parts by weight per 100 parts by weight of the surfactant of the invention from the bubble stability viewpoint.

As the antifoaming agents, there may be mentioned alcohols (e.g. methanol, ethanol, 1-propanol, 2-propanol, lauryl alcohol, stearyl alcohol, etc.) and silicone type compounds (e.g. dimethylsilicone, fluorosilicones, polyether silicones, etc.).

When such an antifoaming agent is contained in the detergent of the invention, the proportion thereof is preferably not higher than 1 part by weight per 100 parts by weight of the surfactant of the invention from the bubble stability viewpoint.

When such other components as mentioned above are contained in the detergent of the invention, the total content of the other components is preferably not higher than 30 parts by weight, more preferably not higher than 20 parts by weight, per 100 parts by weight of surfactant of the invention from the bubble stability viewpoint.

When such other components are contained in the detergent of the invention, the surfactant of the invention and the other component(s) may be separately fed to the microbubble forming apparatus described later herein.

The detergent comprising the surfactant for microbubble formation according to the invention can be used for the cleaning of articles to be cleaned by means of microbubbles formed in water.

The method for cleaning articles to be cleaned according to the invention is a method for cleaning articles to be cleaned which comprises the step of generating microbubbles using the detergent.

As for the method for generating microbubbles for cleaning, use may be made of the process comprising dissolving the detergent of the invention in water added for microbubble formation, if necessary with stirring, and then feeding the solution to any of those microbubble generating equipments known in the art (e.g. of the slit type, porous plate type, porous plate array type, very fine needle type, membrane type, pressure dissolution type, or venture type). Usable as the water are, for example, tap water, water for industrial use, underground water, deionized water, ultra pure water, seawater and lake water.

The gas to be used for microbubble formation is not particularly restricted but every gas can be used. Thus, mentioned may be made of, for example, air, oxygen, nitrogen, carbon dioxide, hydrogen, ozone, helium, argon, or a mixed gas composed of two or more of these. Among these, air is preferred from the viewpoint that it is inexpensive and readily available. These gases may be partly dissolved in water.

The article to be cleaned is not particularly restricted but may be any stained one.

As the stains, there may be mentioned organic matters such as oleaginous matters (machine oils, fats and oils, etc.), fingerprints, sebaceous matters, sweat, resinous matters and organic particles, inorganic matters such as inorganic particles (glass particles, abrasive grains, ceramic particles, metal particles, etc.), and dust, dirt, pollen, mud, ketchup, sauces, coffees, lipstick stains, chili oil stains and like stains found in the ordinary living environment.

Preferred as the article to be cleaned are machine parts, electric and electronic parts, household electric appliances and parts thereof, articles of clothing, tableware, cooking utensils, foods and human bodies, among others.

As the machine parts among such articles to be cleaned, there may be mentioned steel plates or sheets, drawn wires, metal (iron, copper, aluminum, etc.) parts, ceramic parts, machined parts (automobile parts, bearings, clocks/watches), processed metal parts (screws, bolts, shafts, rings, etc.), plated parts, piping, and heat exchangers, among others.

As the electric and electronic parts, there may be mentioned, for example, semiconductor devices, silicon wafers, color filters, electronic device substrates (liquid crystal display panels, plasma, organic EL flat display panels, optical/magnetic discs, CCDs), optical lenses, printed circuit boards, cables for optical communication, LEDs, magnetic heads, connectors, screen plates, etc.

As the household electric appliances and parts thereof, there may be mentioned filters of vacuum cleaners, driers, washing machines, air conditioners and the like, lighting apparatus, dishwashers, water heaters, ventilating fans, cooking range hoods, bathtubs, toilet bowls, beautification equipment and so forth.

As the articles of clothing, there may be mentioned undergarments, upper garments, socks/stockings, gloves, and so forth. As the materials of such articles of clothing, there may be mentioned cotton, nylon, polyester, vinylon and blends thereof as well as natural leather and artificial leather, among others.

As the tableware, there may be mentioned dishes, cups, bowls, teacups, spoons and forks for domestic or business use, among others.

As the cooking utensils, there may be mentioned pans, frying pans, rice cookers, electric kettles, coffee makers, juicers, mixers/blenders, food processors, hot plates, and so forth.

As the foods, there may be mentioned fruits (apples, mandarin oranges, pears, etc.), vegetables (potatoes, sweet potatoes, carrots, etc.), cereals (rice, barley/wheat, etc.) and so forth.

In the case of foods, such dirt as soil adhering to fruits or vegetables or agrochemicals or fruit tree-protecting agents (calcium carbonate etc.) adhering thereto can be removed.

As the method for cleaning such machine parts, electric and electronic parts, household electric appliances and parts thereof, articles of clothing, tableware, cooking utensils, and foods, there may be mentioned, for example, the method comprising equipping a cleaning vessel sufficient large for dipping the article to be cleaned with such a bubble generating equipment as mentioned above in a lower part of the vessel, dipping the cleaning target, namely the article to be cleaned, therein while generating microbubbles therein, maintaining the cleaning target dipped therein for a certain period of time (e.g. 10 to 1,000 seconds) and then pulling up the same.

As for the method for cleaning articles of clothing, a stirring or rotating operation may also be carried out simultaneously according to need while generating microbubbles.

Among the articles to be cleaned, the human bodies include all human body parts, such as hands, face and feet. As the method for cleaning human hands or feet, there may be mentioned the method comprising equipping a cleaning vessel sufficient large for dipping hands or feet with such a bubble generating equipment as mentioned above in a lower part of the vessel, dipping hands, for instance, therein while generating microbubbles therein, maintaining the hands dipped therein for a certain period of time (e.g. 10 to 300 seconds) and then pulling up the same.

In cleaning human bodies, mention may also be made, for example, the method comprising equipping a bathtub, such as a conventional jet bath, with such a bubble generating equipment as described above and cleaning the human body in the bathtub while generating microbubbles therein.

The level of addition (parts by weight) of the detergent of the invention to water, as expressed in terms of the surfactant of the invention, is generally 0.00001 to 5 parts by weight per 100 parts by weight of water used for generating microbubbles and, preferably from the viewpoint of ease of obtaining microbubbles and of bubble stability, it is 0.0001 to 3 parts by weight, particularly preferably 0.01 to 1 part by weight, on the same basis.

In generating microbubbles using the detergent of the invention, the temperature (° C.) of water is not particularly restricted but generally is 5 to 90° C., preferably 10 to 70° C., particularly preferably 15 to 60° C.

The average bubble diameter of microbubbles that can be formed with the surfactant for microbubble formation or the detergent of the invention is generally not greater than 1 mm, preferably not greater than 100 μm, more preferably not greater than 80 μm, particularly preferably not greater than 50 μm. Diameters not greater than 100 μm are preferred from the detergency viewpoint.

The average bubble diameter so referred to herein indicates the area average bubble diameter and can be determined by the method described below.

(1) While generating microbubbles by means of the microbubbles formation test apparatus described later herein, bubbles are photographed at a magnification of 3 using a digital camera (product of Canon Inc., model EOS Kiss Digital N). For obtaining an image of bubbles at rest, use is made of a flash of duration not longer than 1/4,000 second.

(2) A graph paper is placed at the same position as the bubbles and photographed in the same manner as described above, and the photograph is used as a scale in the subsequent process.

(3) The image and scale photographed are captured on a personal computer and, if necessary after magnifying at the same magnification, the diameter of each bubble is measured and the bubbles belonging to each diameter range are counted.

(4) A bubble diameter distribution curve, as shown in FIG. 1, is constructed with the bubble diameter and frequency as the x and y axes, respectively.

(5) The average bubble diameter is calculated using the following formula:

$$\text{(Average bubble diameter)}=\Sigma n_i x_i^{3}/\Sigma n_i x_i^{2}$$

where $x_i$ represents the bubble diameter for range i and, on the occasion of calculation, the center point value for each bubble diameter range, for example 70 μm for the range of 60 to 80 μm in FIG. 1, is used as the value of $x_i$. The symbol $n_i$ represents the number of bubbles falling within the bubble diameter range $x_i$.

The method for cleaning articles to be cleaned according to the invention also includes the method comprising a combination of the cleaning step in which microbubbles are generated with another technique for cleaning.

As the other cleaning technique, there may be mentioned ultrasonic cleaning, shower cleaning, spray cleaning, brush cleaning, dipping, dipping with shaking, single-wafer system cleaning, and a combination of these. From the detergency viewpoint, however, the combination with the ultrasonic cleaning technique is preferred.

As the detergent that can be used in the other washing technique, there may be mentioned detergents for use in or as aqueous, nonaqueous or quasiaqueous systems.

As the detergents for use in aqueous systems, there may be mentioned alkaline detergents (e.g. detergents comprising an alkali builder, a surfactant, a rust preventive, etc.); neutral detergents (e.g. detergents comprising a surfactant, a rust preventive, etc.); and acidic detergents {e.g. detergents comprising an inorganic acid (sulfuric acid, hydrochloric acid, phosphoric acid, etc.) and/or an organic acid (citric acid, sulfamic acid, etc.), a surfactant, an inhibitor, etc.}.

As the nonaqueous detergents, there may be mentioned hydrocarbon-based detergents (e.g. normalparaffin-based detergents, isoparaffin-based detergents, naphthene-based detergents, aromatics-based detergents, etc.); alcohol-based detergents (e.g. isopropyl alcohol-based detergents, ethanol-based detergents, etc.); glycol ether-based detergents; fluorinated detergents {e.g. perfluorocarbons (PFCs), hydrochlorofluorocarbons (HCFCs), hydrofluorocarbons (HFCs), hydrofluoroethers (HFEs), alicyclic hydrofluorocarbons, etc.}; chlorinated detergents (e.g. methylene chloride, trichloroethylene, tetrachloroethylene, etc.); and other non-aqueous detergents (e.g. silicone-based detergents, ester type detergents, N-methylpyrrolidone type detergents, terpenic detergents, etc.).

As the quasiaqueous detergents, there may be mentioned, for example, detergents comprising an organic solvent (alcohol, hydrocarbon, N-methylpyrrolidone, glycol ether, etc.), water and a surfactant.

As regards examples of the combination of cleaning methods, the cleaning step in which microbubbles are generated may be followed by the cleaning step in which another cleaning technique is used, or these steps may be carried out in reverse order or may be carried out simultaneously or, further, the cleaning step in which microbubbles are generated may be carried out in the middle of the whole process.

If necessary, the method for cleaning according to the invention may comprise a rising step and/or a drying step following the cleaning step.

The method for cleaning by means of microbubbles utilizes the gas-liquid interface of bubbles and uses none of those high-concentration organic matters or alkali components in conventional use; hence it is a cleaning method excellent from the viewpoint of environment-friendliness and of safety as well. Therefore, the cleaning process using microbubbles generated by means of the surfactant for microbubble formation according to the invention can take the place of the conventional cleaning processes using solvent-based detergents (hydrocarbon-based detergents, chlorofluorocarbon substitute detergents, glycol ether-based detergents, etc.) or alkaline detergents to thereby produce such effects as reductions in environmental stress and running cost. Furthermore, the cleaning method according to the invention has a marked effect of hardly damaging articles to be cleaned.

The method for generating microbubbles according to the invention is a method for generating microbubbles in water using the surfactant for microbubble formation according to the invention or the detergent according to the invention and, more specifically, the method is the same as the above-mentioned method for generating microbubbles for cleaning.

The microbubbles generated by the method for generating microbubbles according to the invention can suitably be used not only for cleaning purposes but also for purposes of environmental cleanup (water treatment, waste treatment, etc.), separation (oil-water separation, solid-liquid separation), catalysis (catalysts for chemical reactions), recovery from fatigue in living bodies (bathing etc.), chemical reaction medium, disinfection, cultivation of aquatic life, reduction in friction or drag of hulls, and medical application (ultrasonography, calculus pulverization, drug delivery, etc.), among others.

EFFECTS OF THE INVENTION

The surfactant for microbubble formation according to the invention produces good effects: it makes it possible to obtain microbubbles with ease using a conventional microbubble forming apparatus and, further, it can render the microbubbles obtained stable for a long period of time. It produces further effects: it causes less foaming during use and, from the apparatus handling viewpoint, it will not cause any foaming-due troubles.

The microbubbles generated by using the detergent comprising the surfactant for microbubble formation according to the invention are excellent in cleaning effect against dirt or stains due to oleaginous matters, among others.

EXPLANATION OF THE SYMBOLS

Figure 1:
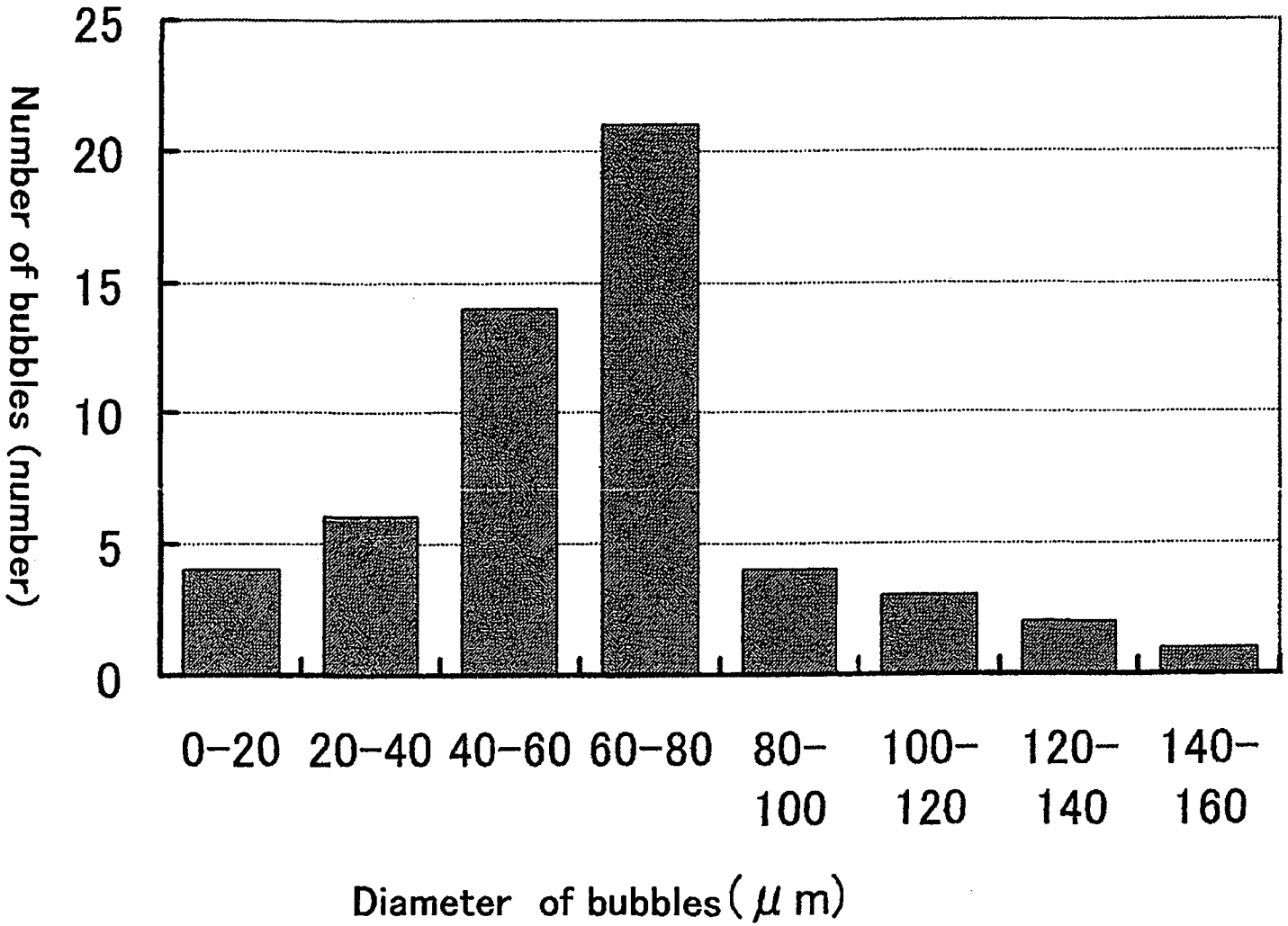
FIG. 1 This is a graphic representation of a bubble diameter distribution.

1 Water tank
2 Ejector
3 Gas inlet port
4 Air pump
5 Liquid inlet port
6 Feeding pump

BEST MODES FOR CARRYING OUT THE INVENTION

The following examples illustrate the present invention in further detail. They are, however, by no means limitative of the scope of the invention. In the following, unless otherwise specified, "%" and "part(s)" mean "% by weight" and "part(s) by weight", respectively.

In the following examples and comparative examples, the foaming power and foam stability were measured by the above-mentioned Ross Miles test (20° C.). Thus, they are the values determined by the procedure according to JIS K 3362 (1998) in the following manner.

1) The inside cylinder of a commercial foaming power measuring apparatus for the Ross Miles test is set up vertically, and a constant temperature (20° C.) is maintained by circulating water as specified through the outer cylinder by means of a pump.
2) A 50-ml portion of the test solution (0.02% (by weight) aqueous solution of the surfactant), while maintained at the same temperature (20° C.), is poured gently into the inside cylinder along the tube wall thereof so that it may wet the whole side of that wall.
3) A 200-ml portion of the test solution is pipetted, the upper end cock of the Ross Miles foaming power measuring apparatus is opened, and the test solution is allowed to flow down so that the whole portion of the test solution may flow out in about 30 seconds and each drop of the solution may fall onto the center of the liquid surface in the inside cylinder.
4) After flowing out of the whole solution, the foam height (foaming power) (mm) is measured by visual observation.
5) Further, after 5 minutes, the foam height (foam stability) (mm) is measured by visual observation.
6) The above procedure is repeated two times, and the means of the respective measured values was calculated to the position of integer and recorded as the foaming power and foam stability.

The SP values given in the examples and comparative examples are the values calculated based on the values described in the above-cited publication Polymer Engineering and Science, Vol. 14, pp. 147-154 (1974).

EXAMPLE 1

A one-liter stainless steel autoclave equipped with a stirrer and a temperature control function was charged with 172 parts of n-propanol and 1.2 parts of potassium hydroxide, and the mixture system inside was purged with nitrogen at room temperature (20° C.) with stirring. Thereafter, a mixture of 126 parts of EO and 499 parts of PO was introduced into the autoclave at a reaction temperature of 120° C. under reduced pressure (−0.05 MPa) until arrival of the gage pressure at 0.1 to 0.3 MPa, and the reaction was allowed to proceed until there was no more pressure change in the system. Thus was obtained an n-propanol-EO(1 mole)-PO(3 moles) random adduct (790 parts). This was designated as "surfactant (A-1) of the invention".

EXAMPLE 2

A one-liter stainless steel autoclave equipped with a stirrer and a temperature control function was charged with 500 parts of a 70% aqueous solution of sorbitol and 1.6 pars of potassium hydroxide, the mixture system inside was purged with nitrogen at room temperature (20° C.) with stirring, the temperature was then raised to 120° C., and the inside of the reaction vessel was dehydrated under reduced pressure (−0.08 MPa) for 2 hours (the water content in the system then became 100 ppm). Then, 466 parts of PO was introduced into the autoclave under reduced pressure (−0.05 MPa) at a reaction temperature of 120° C. until arrival of the gage pressure at 0.1 to 0.3 MPa, and the reaction was allowed to proceed until there was no more pressure change in the system. Thus was obtained a sorbitol-PO(4 moles) adduct (785 parts). This was designated as "surfactant (A-2) of the invention".

EXAMPLE 3

A one-liter stainless steel autoclave equipped with a stirrer and a temperature control function was charged with 120 parts of n-butanol and 1.6 parts of potassium hydroxide, and the mixture system inside was purged with nitrogen at room temperature (20° C.) with stirring. Thereafter, a mixture of 714 parts of EO was introduced into the autoclave at a reaction temperature of 120° C. under reduced pressure (−0.05 MPa) until arrival of the gage pressure at 0.1 to 0.3 MPa, and the reaction was allowed to proceed until there was no more pressure change in the system. Thus was obtained an n-butanol-EO(10 mole) adduct (826 parts). This was designated as "surfactant (A-3) of the invention".

EXAMPLE 4

A one-liter stainless steel autoclave equipped with a stirrer and a temperature control function was charged with 175 parts of allyl alcohol and 0.8 parts of potassium hydroxide, and the mixture system inside was purged with nitrogen at room temperature (20° C.) with stirring. Thereafter, a mixture of 266 parts of EO and 350 parts of PO was introduced into the autoclave at a reaction temperature of 110° C. under atmospheric pressure until arrival of the gage pressure at 0.1 to 0.3 MPa, and the reaction was allowed to proceed until there was no more pressure change in the system. Thus was obtained an allyl alcohol-EO(2 mole)-PO(2 moles) random adduct (783 parts). This was designated as "surfactant (A-4) of the invention".

EXAMPLE 5

A one-liter stainless steel autoclave equipped with a stirrer and a temperature control function was charged with 250 parts of 1,6-hexanediol and 0.8 parts of potassium hydroxide, and the mixture system inside was purged with nitrogen at room temperature (20° C.) with stirring. Thereafter, a mixture of 186 parts of EO and 369 parts of PO was introduced into the autoclave at a reaction temperature of 130° C. under reduced pressure (−0.05 MPa) until arrival of the gage pressure at 0.1 to 0.3 MPa, and the reaction was allowed to proceed until there was no more pressure change in the system. Thus was obtained a 1,6-hexanediol-EO(2 mole)-PO(3 moles) random adduct (797 parts). This was designated as "surfactant (A-5) of the invention".

EXAMPLE 6

A one-liter stainless steel autoclave equipped with a stirrer and a temperature control function was charged with 125 parts of isopropanol and 0.8 parts of potassium hydroxide, and the mixture system inside was purged with nitrogen at room temperature (20° C.) with stirring. Thereafter, a mixture of 183 parts of EO and 483 parts of PO was introduced into the autoclave at a reaction temperature of 110° C. under atmospheric pressure until arrival of the gage pressure at 0.1 to 0.3 MPa, and the reaction was allowed to proceed until there was no more pressure change in the system. Thus was obtained an isopropanol-EO(2 mole)-PO(4 moles) random adduct (785 parts). This was designated as "surfactant (A-6) of the invention".

EXAMPLE 7

A one-liter stainless steel autoclave equipped with a stirrer and a temperature control function was charged with 200 parts of ethylene glycol and 0.8 parts of potassium hydroxide, and the mixture system inside was purged with nitrogen at room temperature (20° C.) with stirring. Thereafter, 639 parts of EO was introduced into the autoclave at a reaction temperature of 130° C. under reduced pressure (−0.05 MPa) until arrival of the gage pressure at 0.1 to 0.3 MPa, and the reaction was allowed to proceed until there was no more pressure change in the system. Thus was obtained an ethylene glycol-EO(4.5 mole) adduct (830 parts). This was designated as "surfactant (A-7) of the invention".

EXAMPLE 8

A one-liter stainless steel autoclave equipped with a stirrer and a temperature control function was charged with 90 parts of ethylenediamine and 0.5 parts of potassium hydroxide, and the mixture system inside was purged with nitrogen at room temperature (20° C.) with stirring. Thereafter, a mixture of 462 parts of EO and 261 parts of PO was introduced into the autoclave at a reaction temperature of 120° C. under reduced pressure (−0.05 MPa) until arrival of the gage pressure at 0.1 to 0.3 MPa, and the reaction was allowed to proceed until there was no more pressure change in the system. Thus was obtained an ethylenediamine-EO(7 mole)-PO(3 moles) random adduct (805 parts). This was designated as "surfactant (A-8) of the invention".

EXAMPLE 9

A one-liter stainless steel autoclave equipped with a stirrer and a temperature control function was charged with 250 parts of synthetic alcohol containing 14 to 15 carbon atoms (product of Mitsubishi Chemical Corporation, "DOBANOL 45") and 0.5 parts of potassium hydroxide, and the mixture system inside was purged with nitrogen at room temperature (20° C.) with stirring. Thereafter, a mixture of 350 parts of EO and 198 parts of PO was introduced into the autoclave at a reaction temperature of 120° C. under reduced pressure (−0.05 MPa) until arrival of the gage pressure at 0.1 to 0.3 MPa, and the reaction was allowed to proceed until there was no more pressure change in the system. Thus was obtained a synthetic alcohol (containing 14 to 15 carbon atoms)-EO(7 mole)-PO(3 moles) random adduct (790 parts). This was designated as "surfactant (A-9) of the invention".

EXAMPLE 10

A one-liter stainless steel autoclave equipped with a stirrer and a temperature control function was charged with 40 parts of 1,2-propylene glycol and 0.8 parts of potassium hydroxide, and the mixture system inside was purged with nitrogen at room temperature (20° C.) with stirring. Thereafter, 885 parts of PO was introduced into the autoclave at a reaction temperature of 120° C. under reduced pressure (−0.05 MPa) until arrival of the gage pressure at 0.1 to 0.3 MPa, and the reaction was allowed to proceed until there was no more pressure change in the system. Thus was obtained a 1,2-propylene glycol-PO(29 mole) adduct (a-10)(920 parts).

The same reaction vessel was charged with 486 parts of the compound mentioned above (a-10), and the system inside was purged with nitrogen in the same way as described above. Thereafter, 340 parts of EO was introduced into the autoclave at a reaction temperature of 140° C. under reduced pressure (−0.05 MPa) until arrival of the gage pressure at 0.1 to 0.3 MPa, and the reaction was allowed to proceed until there was no more pressure change in the system. Thus was obtained a 1,2-propylene glycol-PO(29 mole)-EO(28 moles) block adduct (820 parts). This was designated as "surfactant (A-10) of the invention".

EXAMPLE 11

A one-liter stainless steel autoclave equipped with a stirrer and a temperature control function was charged with 174 parts of the compound obtained in Example 10 (a-10), and the mixture system inside was purged with nitrogen at room temperature (20° C.) with stirring. Thereafter, 62 parts of EO was introduced into the autoclave at a reaction temperature of 140° C. under reduced pressure (−0.05 MPa) until arrival of the gage pressure at 0.1 to 0.3 MPa, and the reaction was allowed to proceed until there was no more pressure change in the system. Thus was obtained a 1,2-propylene glycol-PO(29 mole)-EO(144 moles) block adduct (794 parts). This was designated as "surfactant (A-11) of the invention".

COMPARATIVE EXAMPLE 1

A known surfactant described in the above-cited Non-Patent Document 1, namely 1-pentanol (B-1) (product of Wako Pure Chemical Industries), was used as "surfactant (B-1)" in Comparative Example 1.

COMPARATIVE EXAMPLE 2

Another known surfactant described in the above-cited Non-Patent Document 1, namely Triton(R) X—100 (polyethylene glycol mono-p-isooctylphenyl ether, product of Wake Pure Chemical Industries) was used as "surfactant (B-2)" in Comparative Example 2.

For each of the surfactants of the above-mentioned Examples 1 to 11 and Comparative Examples 1 and 2, the calculated value of SP, the foaming power and foam stability, and the calculate stability/foaming power value were determined. The results thus obtained are shown in Table 1.

TABLE 1

| | | Designation of surfactant | SP value of (A) | Foaming power (mm) | Foam stability (mm) | Foam stability(mm)/ Foaming power(mm) |
|---|---|---|---|---|---|---|
| Example | 1 | A-1 | 9.8 | 10 | 2 | 0.20 |
| | 2 | A-2 | 13.5 | 0 | 0 | — |
| | 3 | A-3 | 9.8 | 10 | 5 | 0.50 |
| | 4 | A-4 | 10.0 | 5 | 0 | 0 |
| | 5 | A-5 | 10.7 | 10 | 0 | 0 |
| | 6 | A-6 | 9.2 | 15 | 5 | 0.33 |
| | 7 | A-7 | 12.0 | 5 | 0 | 0 |
| | 8 | A-8 | 9.4 | 30 | 10 | 0.33 |
| | 9 | A-9 | 9.3 | 50 | 35 | 0.70 |
| | 10 | A-10 | 9.2 | 35 | 10 | 0.29 |
| | 11 | A-11 | 9.3 | 40 | 15 | 0.38 |
| Comparative Example | 1 | B-1 | 11.0 | 20 | 0 | 0 |
| | 2 | B-2 | 9.9 | 65 | 60 | 0.92 |

EXAMPLES 12 to 22 and COMPARATIVE EXAMPLES 3 to 5

Using each of the above-mentioned surfactants, such a microbubble formation test and cleaning test as described below were carried out.

<Microbubble Formation Test>

Figure 2:
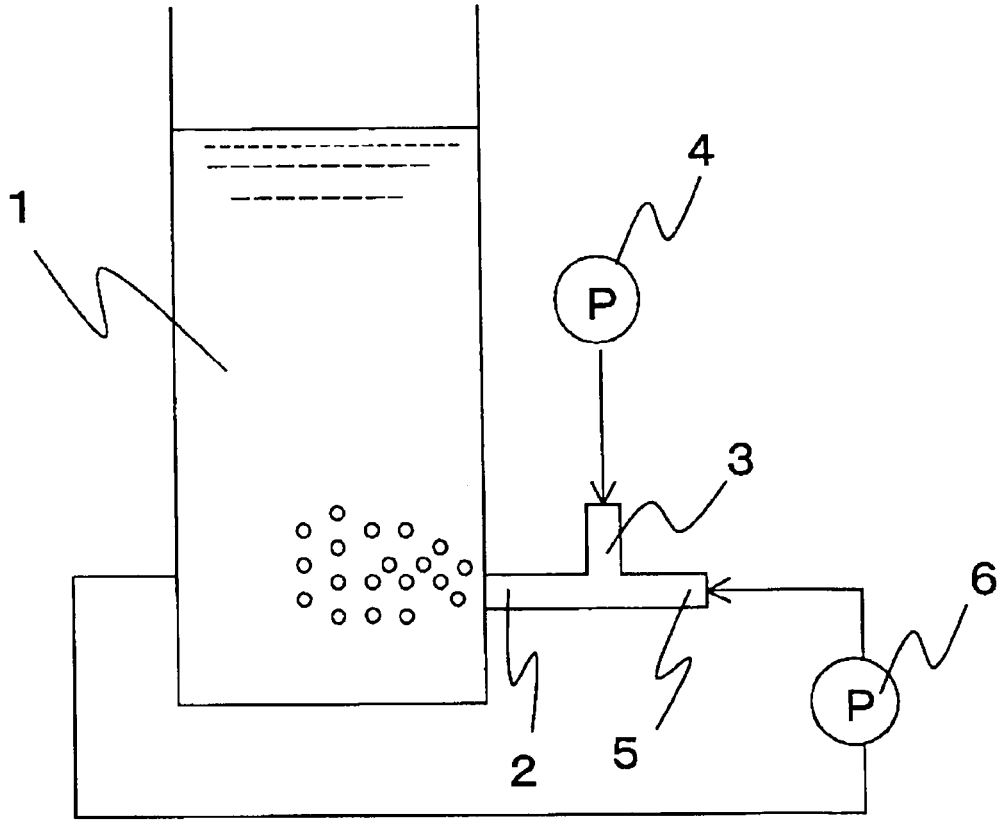
FIG. 2 This is a schematic representation of a microbubble forming apparatus.

The microbubble formation test was carried out using the microbubble generating equipment shown in FIG. 2.

An acrylic panel-made water tank 1 (20 cm in depth×20 cm in width×45 cm in height) with the top opened to the atmosphere was equipped with an ejector 2 (product of Mazze Injector Corp., model No. 484) in a lower part (10 cm from the bottom) of a side face, and the gas inlet port 3 of the ejector 2 was connected to an air pump 4 (product of Iwaki Co., Ltd., model APN215CV-1) and the liquid inlet port 5 was provided with a feeding pump 6 (product of Iwaki, model MD70RM). Further, the drain in a lower part of the water tank 1 was connected to the feeding pump 6 so that the liquid within the water tank might be circulated.

Deionized water (15 L) and 15 g of one of the surfactants (A-1) to (A-11) of Examples 1 to 11 and the surfactants (B-1) to (B-2) of Comparative Examples 1 and 2 were fed to the above apparatus (corresponding to Examples 12 to 22 and Comparative Examples 3 and 4, respectively), or deionized water alone was fed (corresponding to Comparative Example 5), and microbubbles were caused to form for 1 minute at a water temperature of 30° C., an air flow rate of 15 L/min and a liquid feed flow rate of 6.5 L/min. The degree of turbidity during operation was judged by the eye according to criteria shown below. Then, the liquid phase was allowed to stand for 3 minutes just after stopping the operation of the apparatus and the degree of turbidity was judged in the same manner. The results thus obtained are shown in Table 2.

Excellent: The bubble diameter is very small (the opposite side of the water tank can hardly be seen).

Fine: The bubble diameter is small (the opposite side can be slightly seen).

Good: The bubble diameter is relatively large (the opposite side can be seen to some extent).

Bad: The bubble diameter is large, with disappearance of the bubbles in the lower layer.

Worst: Disappearance of most bubbles.

During the above-mentioned bubble formation test, the foam breakability was judged according to the criteria shown below. The results thus obtained are shown in Table 2.

Excellent: Foam rapidly disappears on the surface of the water and no overflow of foam occurs from the top of the vessel.

Fine: Foaming occurs up to the upper part of the vessel but no overflow of foam occurs from the top of the vessel.

Bad: A large amount of foam is formed and an overflow of foam occurs from the top of the vessel.

<Average Bubble Diameter Measurement>

Average bubble diameter measurements were carried out by the method described hereinabove, namely in the following manner.

(1) While generating microbubbles by means of the microbubbles formation test apparatus described hereinabove, bubbles were photographed at a magnification of 3 using a digital camera (product of Canon Inc., model EOS Kiss Digital N). For obtaining an image of bubbles at rest, use was made of a flash of duration not longer than 1/4,000 second.

(2) A graph paper was placed at the same position as the bubbles and photographed in the same manner as described above, and the photograph was used as a scale in the subsequent process.

(3) The image and scale photographed were captured on a personal computer, and the diameter of each bubble was measured and the bubbles belonging to each diameter range were counted.

(4) A bubble diameter distribution curve, as shown in FIG. 1, was constructed with the bubble diameter and frequency as the x and y axes, respectively.

(5) The average bubble diameter was calculated using the following formula:

$$\text{(Average bubble diameter)}=\Sigma n_i x_i^3/\Sigma n_i x_i^2$$

where $x_i$ represents the bubble diameter for range i and, on the occasion of calculation, the center point value for each bubble diameter range was used as the value of $x_i$. The symbol $n_i$ represents the number of bubbles falling within the bubble diameter range $x_i$. The results thus obtained are shown in Table 2.

<Cleaning test 1>

A 2 cm×5 cm test plate (material: SUS304 stainless steel) was immersed in a solution prepared by dissolving 18 g of liquid paraffin (product of Sanko Chemical Co.) in 582 g of n-hexane in a one-liter glass beaker. After 60 seconds of immersion, the substrate was taken out with a pair of forceps and the n-hexane was allowed to evaporate at room temperature (about 20° C.) to give a stained test plate with liquid paraffin adhering to the test plate surface.

Using the microbubble formation test apparatus mentioned above and adding 15 g of one of the surfactants (A-1) to (A-11), (B-1) and (B-2) or using deionized water alone without surfactant addition, the microbubble formation was started at a water temperature of 30° C. in the same manner as in the above microbubble formation test. During microbubble generation, the above-prepared stained test plate was immersed in the bath in the middle of the vessel at a depth of about 15 cm from the water surface with a pair of forceps. After 180 seconds of immersion while causing microbubbles to form, the test plate was taken out of the vessel, the surface thereof was dried at room temperature by blowing nitrogen thereon to remove the moisture, the liquid paraffin remaining on the test plate surface after cleaning was extracted with 20 ml of an oil extracting solvent (product of Asahi Glass Co., H-997) and, thereafter, the oil concentration was measured using an oil content meter (product of Horiba, Ltd., OCMA-355). On that occasion, in case the concentration exceeded the measurement range (1 to 200 mg/L) of that oil content meter, the extract was analyzed after dilution with the extracting solvent so that the oil concentration might fall within the measurement range. Based on the measured value (mg/L) obtained, the residual oil amount (μg/cm$^2$) on the test plate surface was calculated according to the formula given below. In the formula, x represents the dilution factor in the case of dilution with the extracting solvent.

The residual oil amount on the stained test plate before cleaning was 1,450 μg/cm$^2$.

The results thus obtained are shown in Table 2.

$$\text{Residual oil amount } (\mu g/cm^2)=\text{value measured by oil content meter } (mg/L)\times 2\times x$$

<Cleaning test 2>

The test was carried out and the residual oil amount (μg/cm$^2$) was determined in the same manner as in Cleaning test 1 except that beef tallow (product of Nippon Fine Chemical Co.) was used in lieu of liquid paraffin. The residual oil amount on the stained test plate before cleaning was 1,800 μg/cm$^2$. The results thus obtained are shown in Table 2.

<Cleaning Test 3>

A stained dish was prepared by applying, to a porcelain dish having a diameter of 15 cm, 5 g of a paste prepared by weighing retort curry, cooked rice and water in the ratio of 1:1:1 and mixing up them in a mixer, followed by 24 hours of standing at room temperature. The microbubble formation was started in the same manner as in the above-mentioned Cleaning test 1 except that the water temperature was adjusted to 60° C. The above-prepared stained dish was immersed in the bath in the vessel during microbubble formation and, after 300 seconds of cleaning, the stained dish was taken out of the vessel. The dish after cleaning was dried at room temperature for 24 hours and then the dish was weighed. Based on these values and the weight of the dish before cleaning, the percentage of cleaning was calculated as follows:

$$\text{Cleaning percentage (\%)}=\{(S_1-S_2)/(S_1-S_0)\}\times 100.$$

In the formula, $S_0$ represents the weight of the dish before stain application, $S_1$ represents the weight of the dish after stain application, further followed by drying, and $S_2$ represents the weight of the dish after cleaning, further followed by drying.

The results thus obtained are shown in Table 2.

<Cleaning Test 4>

The microbubble formation was started in the same manner as in the above-mentioned Cleaning test 1 and, during microbubble formation, a wet-type artificially stained cloth (product of Zaidan-Hojin Sentaku Kagaku Kyokai (Japan Society of Laundry Science), reflectivity at 540 nm: 40±5%) stained with the dirt composition shown below in Table 3 was immersed in the bath at a depth of about 15 cm from the water surface in the middle of the vessel using a pair of forceps. After 600 seconds of immersion with microbubble formation, the stained cloth was taken out of the vessel, and the detergency was calculated for evaluation according to the following formula:

$$\text{Detergency (\%)}=\{(R_w-R_s)/(R_1-R_s)\}\times 100$$

where $R_1$ represents the reflectivity of the clean cloth, $R_w$ represents the reflectivity of the washed cloth and $R_s$ represents the reflectivity of the stained cloth. Reflectivity measurements were made at 540 nm using a multiple-light-source spectrocolorimeter (product of Suga Test Instruments Co.).

The following evaluation criteria were employed: Excellent—detergency not lower than 40%, Fine—detergency not lower than 32% but lower than 40%, Good—detergency not lower than 20% but lower than 32%, Bad—detergency lower than 20%.

The results thus obtained are shown in Table 2.

TABLE 3-continued

| Component name | | Content (% by weight) |
|---|---|---|
| | Liquid paraffin | 2.5 |
| | Squalene | 2.5 |
| | Cholesterol | 1.6 |
| Protein | Gelatin | 7.0 |
| Inorganic components | Mud | 29.8 |
| | Carbon black | 0.5 |

The results shown in Table 1 and Table 2 revealed that the surfactants of the invention can readily form microbubbles and are effective in stabilizing the microbubbles formed. It was also revealed that they have also an effect such that foam formation is small in degree on the occasion of use thereof. Further, it was found that the microbubbles formed with the surfactants of the invention have a cleaning effect. In view of the foregoing, the surfactants of the invention can be expected to produce the effect of the microbubbles formed at its maximum and, since they will not cause any foam-due trouble in apparatus handling, they can suitably be used as surfactants for microbubble formation or detergents.

INDUSTRIAL APPLICABILITY

The surfactant for microbubble formation according to the invention can possibly be used as a surfactant for use in those fields of application where microbubbles are utilized, for example in the fields of washing, cleaning, separation, catalysis, recover from fatigue in living bodies, chemical reaction medium, disinfection, cultivation of aquatic plants or animals, reduction in drag on hulls, and medicine (ultrasonography, calculus breaking, drug delivery, etc.), among others.

TABLE 2

| | | Microbubble forming test | | | | Detergency testing | | | |
|---|---|---|---|---|---|---|---|---|---|
| | Designation of surfactant used | During operation | 3 minutes after stopping | Foam breakability | Average bubble diameter (μm) | Cleaning test 1 [residual oil amount (μg/cm²)] | Cleaning test 2 [residual oil amount (μg/cm²)] | Cleaning test 3 [cleaning percentage (%)] | Cleaning test 4 |
| Example 12 | A-1 | Excellent | Fine | Excellent | 42 | 7.4 | 9.2 | 90 | Excellent |
| 13 | A-2 | Excellent | Fine | Excellent | 48 | 3.5 | 5.2 | 95 | Excellent |
| 14 | A-3 | Excellent | Fine | Excellent | 34 | 5.0 | 4.8 | 92 | Excellent |
| 15 | A-4 | Excellent | Fine | Excellent | 30 | 4.1 | 4.2 | 94 | Excellent |
| 16 | A-5 | Excellent | Fine | Excellent | 50 | 7.3 | 3.9 | 95 | Excellent |
| 17 | A-6 | Excellent | Fine | Excellent | 22 | 6.4 | 5.0 | 92 | Excellent |
| 18 | A-7 | Excellent | Fine | Excellent | 49 | 6.8 | 6.1 | 88 | Fine |
| 19 | A-8 | Excellent | Fine | Fine | 28 | 5.8 | 7.9 | 91 | Excellent |
| 20 | A-9 | Fine | Fine | Fine | 50 | 8.2 | 9.8 | 90 | Excellent |
| 21 | A-10 | Fine | Fine | Fine | 72 | 9.2 | 10.5 | 87 | Fine |
| 22 | A-11 | Fine | Fine | Fine | 94 | 9.6 | 11.3 | 89 | Fine |
| Comparative Example 3 | B-1 | Good | Bad | Excellent | 110 | 18.3 | 26.3 | 51 | Bad |
| 4 | B-2 | Fine | Fine | Bad | 52 | 11.6 | 15.2 | 75 | Fine |
| 5 | No surfactant | Good | BadBad | Excellent | — | 353.5 | 561.3 | 36 | Bad |

TABLE 3

| Component name | | | Content (% by weight) |
|---|---|---|---|
| Organic components | Oil/fat components | Oleic acid | 28.3 |
| | | Triolein | 15.6 |
| | | Cholesterol oleate | 12.2 |

The invention claimed is:

1. A method for cleaning articles to be cleaned by microbubbles, comprising:

preparing a detergent comprising a surfactant for microbubble formation;

generating microbubbles by feeding the prepared detergent to a microbubble generator to obtain microbubbles having a gas-liquid interface; and cleaning the article by contacting the microbubbles with the article and utilization of the gas-liquid interface of the generated microbubbles;

wherein the surfactant for microbubble formation comprises:

a (poly)oxyalkylene adduct (A) of an active hydrogen atom-containing compound (a) as represented by formula (1):

$$Z\text{-}[(AO)_n\text{—}H]_p \quad (1)$$

wherein

Z is a residue of an active hydrogen-containing compound (a) with a valence of P as resulting from removal of the active hydrogen atom or atoms;

A is an alkylene group containing 1 to 8 carbon atoms;

n is an integer of 1 to 400; and p is an integer of 1 to 100;

wherein the microbubble generator is at least one selected from the group consisting of a slit, a porous plate, a fine needle, a membrane and a venturi, a foaming power of a 0.02% by weight aqueous solution of the (poly)oxyalkylene adduct (A) as measured at 20° C. by the Ross Miles test is not higher than 50 mm.

2. The method for cleaning according to claim 1, wherein the article to be cleaned is one selected from the group consisting of a machine part, an electric part, an electronic part, a household electric appliance, a part of a household electric appliance, an article of clothing, a food, tableware, a cooking utensil and a human body.

3. The method for cleaning according to claim 1, wherein A in formula (1) is at least one species selected from the group consisting of an ethylene group, a 1,2-propylene group, a 1,2-butylene group, a 1,4-butylene group and a 1-phenyl-1,2-ethylene group.

4. The method for cleaning according to claim 1, wherein the active hydrogen atom-containing compound (a) is an alcohol comprising 2 to 8 hydroxyl groups.

5. The method for cleaning according to claim 1, wherein n in formula (1) is 1 to 175.

6. The method for cleaning according to claim 1, wherein a foam stability of the surfactant is not higher than 35 mm, wherein the foam stability is the foam height after a lapse of 5 minutes just following completion of flowing out of all the test solution in the Ross Miles test.

7. The method for cleaning according to claim 6, wherein a foaming power of the surfactant is 0 mm, or is 1 to 50 mm and a ratio between foam stability and foaming power as represented by [foam stability (mm)/foaming power (mm)] is 0 to 0.70.

8. The method for cleaning an article according to claim 1, further comprising:

preparing an aqueous solution of the detergent and bubbling a gas into the aqueous solution of the detergent.

9. The method for cleaning an article according to claim 1, wherein the detergent further comprises a water soluble organic solvent.

10. The method for cleaning an article according to claim 9, wherein the water soluble organic solvent is at least one selected from the group consisting of a sulfoxide, a sulfone, an amide, a lactam, a lactone, an alcohol and a glycol.

11. The method for cleaning an article according to claim 1, wherein the detergent, further comprises at least one component selected from the group consisting of a surfactant different from the surfactant according to claim 1, an antifoaming agent, an antioxidant, a chelating agent, a rust preventive, a pH adjusting agent and a pH buffering agent.

12. The method for cleaning an article according to claim 11, wherein a parts by weight of the at least one further comprised component is not higher than 30 parts by weight per 100 parts by weight of the surfactant of formula (1).

13. The method for cleaning an article according to claim 1, wherein an average bubble diameter of the microbubbles generated is not greater than 1 mm.

14. The method for cleaning articles according to claim 13, wherein the average bubble diameter is not greater than 100 μm.

15. The method for cleaning an article according to claim 1, wherein the active hydrogen-containing compound is a polyhydroxy compound selected from the group consisting of ethylene glycol, 1,2-propylene glycol, 1,3-propylene glycol, 1,3-butylene glycol, 1,4-butanediol, 1,6-hexanediol, 3-methylpentanediol, diethylene glycol, neopentyl glycol, 1,4-bis(hydroxymethyl)cyclohexane, 1,4-bis(hydroxyethyl)benzene, 2,2-bis(4,4'-hydroxycyclohexyl)-propane, glycerol, trimethylolpropane, pentaerythritol, diglycerol, triglycerol, α-methyl glucoside, sorbitol, xylitol, mannitol, dipentaerythritol, glucose, fructose and sucrose.

16. The method for cleaning an article according to claim 15, wherein the polyhydroxy compound is ethylene glycol, 1,2-propylene glycol, 1,6-hexanediol or sorbitol.

* * * * *